United States Patent [19]

Villeval

[11] Patent Number: 4,457,363

[45] Date of Patent: Jul. 3, 1984

[54] WATER BOX AND EXPANSION CHAMBER STRUCTURE FOR A HEAT EXCHANGER

[75] Inventor: Denis Villeval, Maurepas, France

[73] Assignee: Valeo, Paris, France

[21] Appl. No.: 374,796

[22] Filed: May 4, 1982

[30] Foreign Application Priority Data

May 12, 1981 [FR] France ..... 81 09442

[51] Int. Cl.[3] ..... F01P 11/02

[52] U.S. Cl. ..... 165/104.32; 123/41.54; 55/191

[58] Field of Search ..... 165/104.32, 111, DIG. 24; 123/41.54, 41.51, 41.44; 55/191

[56] References Cited

U.S. PATENT DOCUMENTS 4,199,332 4/1980 Krohn et al. ..... 55/191
4,366,858 1/1983 Moranne ..... 165/104.32

FOREIGN PATENT DOCUMENTS 2312645 12/1976 France .
2465986 3/1981 France .
2007831 5/1979 United Kingdom ..... 123/41.54

*Primary Examiner*—Albert W. Davis, Jr.
*Attorney, Agent, or Firm*—Dennison, Meserole, Pollack & Scheiner

[57] ABSTRACT

A water box (10) and an expansion chamber (11) for a heat exchanger, in particular for a radiator in a motor vehicle, form a single structrue. The expansion chamber (11) and the water box (10) are interconnected by a degassing conduit (24–27) which injects a mixture of gas and liquid substantially tangentially into the expansion chamber. The expansion chamber has a suction orifice (14) through which liquid is drawn into the heat exchanger circuit. Means (35) are provided in the expansion chamber to slow down or prevent rotational motion of the liquid inside the expansion chamber in the vicinity of the suction orifice (14). This serves to reduce the amount of gas that is accidentally entrained into the liquid circuit from the degassing conduit.

7 Claims, 3 Drawing Figures

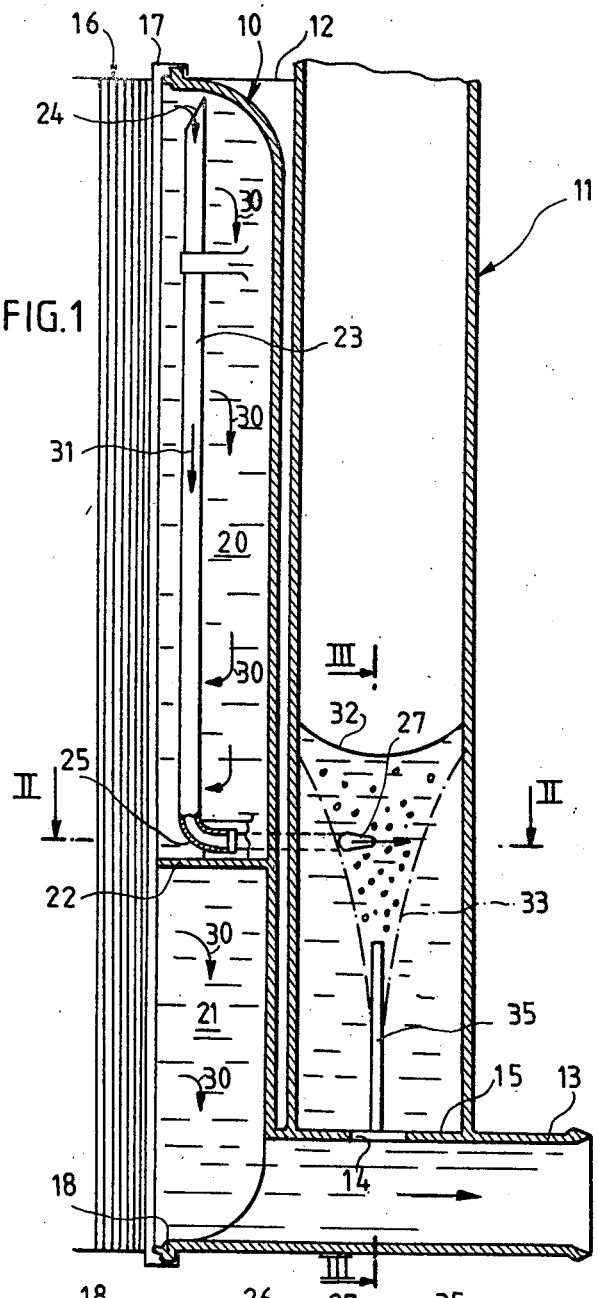
FIG.1
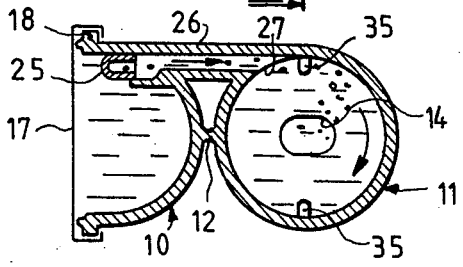
FIG. 2
FIG. 3
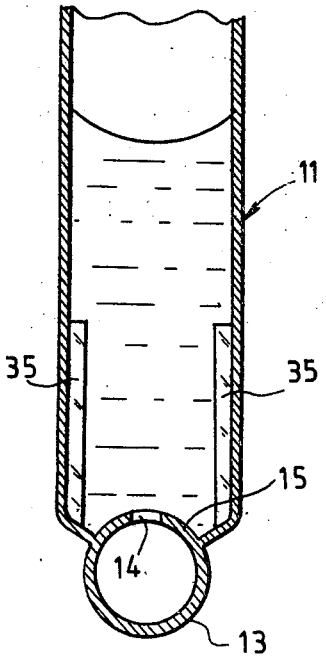

WATER BOX AND EXPANSION CHAMBER STRUCTURE FOR A HEAT EXCHANGER

The invention relates to a water box and expansion chamber structure for a heat exchanger, in particular for a radiator forming a part of the cooling circuit of a motor vehicle.

BACKGROUND OF THE INVENTION

In such a structure, the expansion chamber and the water box are generally interconnected by a degassing conduit which runs from the top of the water box and opens out in the expansion chamber. It is advantageous for said conduit to open out below the normal level of liquid in the expansion chamber, since this helps to reduce the risks of air or gas being drawn into the conduit when the motor is stopped.

It is also advantageous for the degassing conduit to open out tangentially into the expansion chamber (which is generally of substantially circular section) or at least at a small angle to the wall of the chamber, since this leads to the formation of an eddy or a vortex in the chamber, thereby increasing the period of time for which the bubbles pass through the liquid which favours separation of gas and liquid, and hence provides improved degassing of the liquid.

However, it has been observed in practice that the degassing efficiency of such a water box and expansion chamber structure is lower than expected, in the main because the bubbles of air or gas are drawn back into the cooling circuit via the suction orifice which is generally at the bottom of the expansion chamber and which leads either to the outlet tube from the heat exchanger or else to the water box.

Preferred embodiments of the present invention avoid this drawback in a simple, cheap and efficient manner.

SUMMARY OF THE INVENTION

The present invention provides a water box and expansion chamber structure in which the water box and the expansion chamber are interconnected by a degassing conduit or orifice which opens out below the normal level of liquid in the expansion chamber, and in which the expansion chamber communicates with the main liquid circuit via a suction orifice located at or near the bottom of the expansion chamber, wherein the structure includes means suitable for slowing rotational movement of liquid in the expansion chamber in the vicinity of the suction orifice.

Thus, by preventing a vortex from forming near the bottom of the expansion chamber, bubbles of air or gas present in the liquid are prevented from collecting above the suction orifice at the bottom of the expansion chamber, and hence from being drawn into the liquid circuit of the exchanger during a sudden period of suction, eg. when the motor accelerates.

Advantageously, the rotational movement of the liquid in the expansion chamber is not slowed at a distance from the suction orifice, since such rotational movement is beneficial to gas/liquid separation, and hence to degassing the liquid.

Preferably said means for slowing rotational movement of the liquid comprise substantially vertical ribs or fins depending inwardly from the wall of the expansion chamber.

BRIEF DESCRIPTION OF THE DRAWING

An embodiment of the invention is described by way of example with reference to the accompanying drawing, in which:

FIG. 1 is a partial longitudinal section through a water box and expansion chamber structure in accordance with the invention;

FIG. 2 is a section along a line II—II of FIG. 1; and

FIG. 3 is a partial section along a line III—III of FIG. 1.

MORE DETAILED DESCRIPTION

In the embodiment shown in the drawing, the structure in accordance with the invention comprises a water box 10 and an expansion chamber 11 which are moulded as a single piece and are held together by a thin strip 12 which is moulded at the same time. The water box 10 is of substantially semi-circular section, while the expansion chamber 11 is cylindrical and of substantially circular section.

An outlet tube 13 from the heat exchanger extends from the bottom of the water box 10 and communicates with the expansion chamber 11 via a suction orifice 14 at the bottom 15 thereof.

The structure comprising the water box 10 and the expansion chamber 11 is mounted on a nest of finned heat exchanger tubes by means of a tube plate 17 having edges which are conventionally fitted with claws or tabs that are folded over a peripheral rim 18 on the water box 10.

The inside volume of the water box is divided into two chambers 20 and 21 by a transverse partition 22. The upper chamber 20 houses a vertical degassing tube 23 which has a chamfered top end 24 which opens out at the top of the chamber 20, and which has a bent bottom end 25 fitted in a substantially sealed manner into an inlet end of a conduit 26 whose outlet end 27 opens out inside the expansion chamber 11 below the normal level of the liquid contained therein. In this embodiment, the conduit 26 extends horizontally and forms part of the same moulding as the water box 10 and the expansion chamber 11.

In operation, bubbles of air or gas conveyed by the liquid flowing round the heat exchanger tend to collect in the upper portion of the water box 10 (the liquid flowing through h the water box in the direction indicated by arrows 30). A mixture of gas and liquid is thus picked up by the top end 24 of the tube 23 and flows therethrough in the direction of an arrow 31, to pass into the expansion chamber via the end 27 of the conduit 26, by virtue of the suction developed in the expansion chamber 11 by the liquid flowing along the outlet tube 13 from the heat exchanger.

In this embodiment, the conduit 26 opens out into the expansion chamber 11 substantially tangentially to the wall thereof, such that the mixture of gas and water ejected via the outlet 27 from the conduit 26 imparts rotational movement to the liquid in the expansion chamber, causing the free surface of the liquid to form a meniscus 32 as shown in FIG. 1. A consequence of the rotational movement of the liquid in the expansion chamber is that the bubbles of air or gas leaving the conduit 26 tend to collect in the middle of the vortex, ie. on or near the vertical axis of the expansion chamber 11, even while rising towards the free surface of the liquid.

At the same time, the liquid in the expansion chamber 11 is drawn through the orifice 14 at the bottom 15 of the expansion chamber into the outlet tube 13 from the heat exchanger in such a manner that the bubbles of air or gas in the liquid tend to concentrate in a zone of generally conical shape as shown by a chain dotted outline 33 in FIG. 1. The apex of the cone points down towards the suction orifice 14.

It has been observed that, in practice, the suction orifice 14 draws off bubbles of air or gas, particularly when the motor is accelerating.

To avoid this drawback, the invention provides means for slowing down or preventing rotational movement in the liquid near to the bottom 15 of the expansion chamber 11. It is the rotational movement in conjunction with the suction via the orifice 14 that causes the cone 33 to form and which leads to air being drawn into the liquid circuit.

In the embodiment shown, said means are constituted by vertical ribs or fins 35 projecting radially inwardly from the wall of the expansion chamber and extending substantially from the bottom 15 up to a point some way below the outlet 27 of the conduit 26.

There are, for example, two diametrically opposite radial ribs or fins 35 as shown, to slow down or prevent the liquid from rotating about the vertical axis of the expansion chamber 11 throughout the lower portion of the expansion chamber, thereby preventing bubbles of air from concentrating above or near the suction orifice 14.

The ribs 35 may extend up as far the outlet 27 from the conduit 26, but it is advantageous for them to terminate some way below, so that the liquid above the fins 35 can take up a rotational motion to improve gas/liquid separation.

Both the radial extent and the height of the fins depend on the conditions under which the heat exchanger is used and, in particular, it is not necessary for the fins to extend right into the center of the expansion chamber.

The conduit 26 could be slightly upwardly directed instead of being horizontal, thereby guiding the bubbles towards the free surface of the liquid contained in the expansion chamber 11. Further, the suction orifice 14 need not necessarily be centred on the axis of symmetry of the expansion chamber cylinder, and it need not be located at the bottom 15 of the chamber 11, a location near to the bottom being sufficient.

I claim:

1. A water box and expansion chamber structure for a heat exchanger, in particular for a radiator in a motor vehicle, wherein the expansion chamber and the water box are interconnected by a degassing conduit or orifice, wherein the expansion chamber has a suction orifice, and wherein means are provided in the expansion chamber to slow down or prevent rotational motion of the liquid in the expansion chamber in the vicinity of the suction orifice, said means comprising at least one radially inwardly directed fin or rib extending vertically along the inside wall of the expansion chamber.

2. A structure according to claim 1, wherein the suction orifice is formed in or near the bottom of the expansion chamber.

3. A structure according to claim 1, wherein the degassing conduit opens out into the expansion chamber below the normal level of liquid therein.

4. A structure according to claim 1, wherein the degassing conduit leads into the expansion chamber and wherein said means for slowing down or preventing rotational motion comprise at least one radially inwardly directed fin or rib extending vertically along the inside wall of the expansion chamber.

5. A structure according to claim 4, wherein said fin or rib extends from the bottom of the expansion chamber up to a predetermined distance below the outlet of the degassing conduit.

6. A structure according to claim 4, wherein said fin projects inwardly by a distance less than the radius of the expansion chamber.

7. A structure according to claim 4, having two diametrically opposite fins or ribs.

* * * * *